United States Patent [19]

Tobias

[11] 4,165,677

[45] Aug. 28, 1979

[54] RADIAL PISTON HYDRAULIC PUMP OR MOTOR WITH STABILIZED PINTLE SHAFT

[75] Inventor: Jaromir Tobias, New York, N.Y.

[73] Assignee: American Hydraulic Propulsion Systems, Inc., Englewood, N.J.

[21] Appl. No.: 881,554

[22] Filed: Feb. 27, 1978

[51] Int. Cl.[2] ..... F01B 13/06

[52] U.S. Cl. ..... 91/497; 92/12.1

[58] Field of Search ..... 91/491, 497; 92/12.1

[56] References Cited

U.S. PATENT DOCUMENTS

| | | | |
|---|---|---|---|
| 3,709,104 | 1/1973 | Culberson | 91/495 |
| 3,771,423 | 11/1973 | Culberson | 91/497 |

FOREIGN PATENT DOCUMENTS

| | | | |
|---|---|---|---|
| 28555 | 3/1925 | France | 91/497 |

*Primary Examiner*—William L. Freeh

*Attorney, Agent, or Firm*—Brumbaugh, Graves, Donohue & Raymond

[57] ABSTRACT

The pintle shaft of a radial piston hydraulic pump-motor is cantilevered from one end frame member by guideways which permit it to be moved laterally for adjustment of the speed, torque output and direction of rotation. A reaction assembly is journaled in a second frame member by means of the input-output shaft. The reaction assembly includes two reaction rings, one on either side of the cylinder block, which rotate on bearing blocks on the pintle shaft, the bearing blocks and shaft having interengaging parallel, flat slide surfaces which permit the shaft to be translated while still being in mutually supported and stabilized relation with the reaction rings. The side loads on the pintle shaft are counteracted by friction forces developed between the slide surfaces on the bearing blocks and pintle shaft so that the pintle shaft remains stable relative to the reaction assembly without direct mechanical support of its blind end against side loads.

9 Claims, 4 Drawing Figures

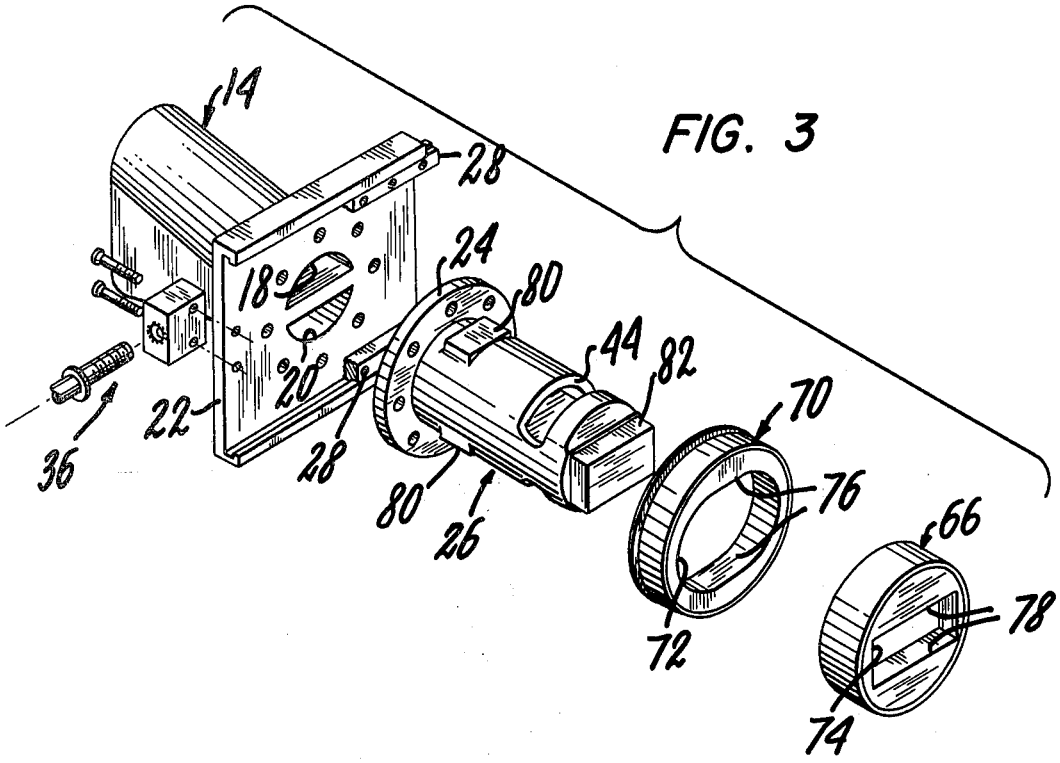
FIG. 3
FIG. 4
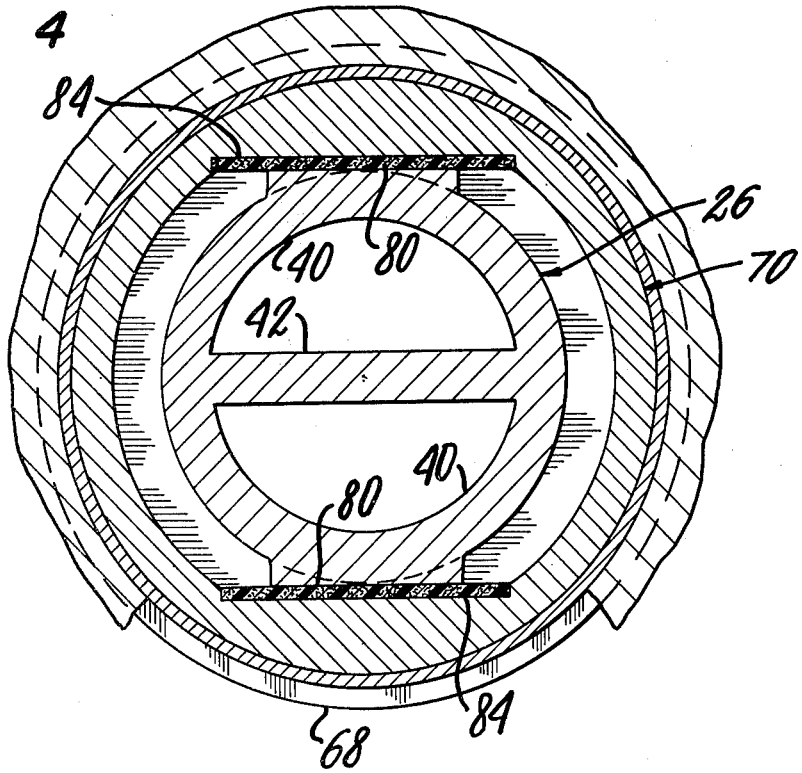

RADIAL PISTON HYDRAULIC PUMP OR MOTOR WITH STABILIZED PINTLE SHAFT

BACKGROUND OF THE INVENTION

This invention relates to improvements in the construction of radial piston hydraulic pumps and motors and, in particular, to the mounting of the pintle shaft so that it remains stable and essentially vibration free, thus reducing wear and noise and increasing efficiency.

U.S. Pat. No. 3,771,423, issued Nov. 13, 1973, for "Radial Pump or Motor With Stabilized Pintle" describes and shows radial piston hydraulic pump-motors having cantilevered pintle shafts and various mechanical devices for supporting the blind end of the pintle shaft against side loads. For various reasons it is advantageous to mount the pintle shaft at one end on a frame member as in the pump-motor described in that patent. However, the fact that the pintle shaft of such a pump-motor is mounted to be moved laterally for torque and speed control causes some problems.

The pump-motor of the aforementioned patent comprises a pair of end frame members, the pintle shaft being cantilevered from and mounted to slide laterally on one, and the reaction assembly being journaled by way of the input-output shaft on the other. The reaction assembly includes a pair of reaction rings, one on either side of the cylinder block, each of which is connected to each piston by one or more Scott-Russell linkages (see U.S. Pat. No. 3,709,104 issued Jan. 9, 1973 for "Radial Piston Hydraulic Pump or Motor With Low Loss Reaction Linkage"). The Scott-Russell linkages eliminate all side loads on the pistons; accordingly, each piston exerts or is subject to only a radial force. For example, in the motor mode, the hydraulic fluid delivered to the cylinders on the charge or high pressure side produces radially outward forces on the corresponding pistons, and the reaction assembly imposes radially inward forces on the pistons on the discharge or low pressure side. For purposes of analyzing the loads on the pintle shaft (as distinguished from a full analysis of the stresses on the pintle shaft which involves consideration of the hydrostatic pressure in the pintle) the radially acting and reacting forces on the pistons can be resolved into components acting (1) perpendicular to the plane of lateral movement or adjusting translation of the pintle shaft (i.e., components perpendicular to the pintle bridge and hereinafter referred to as "perpendicular loads") and (2) parallel to the plane of adjusting translation (hereinafter called "side loads"). The perpendicular loads are unidirectional from the high pressure side toward the low pressure side in any given mode of operation of the pump-motor and are generally of the order of roughly two to five times the maximum side loads, depending primarily upon the number of cylinders, the cylinder diameters and the widths of the land areas of the pintle bridge. The side loads are cyclical in magnitude and direction, the number of cycles of load change per revolution being equal to the number of cylinders.

In the pump-motors of U.S. Pat. No. 3,771,423, the reaction assembly has a bearing adjacent the blind end of the pintle shaft, and a pair of slide pins on the pintle shaft are received in a slot in that bearing, thus permitting the pintle shaft to be adjusted laterally. The pins transfer part of the perpendicular loads between the pintle shaft and the reaction assembly but afford very little transfer of side loads between the pintle shaft and reaction assembly. Accordingly, the pintle shaft is subject to oscillatory rocking in the lateral direction, and one or another form of mechanical restraining system is provided to stabilize the pintle shaft against rocking.

The reaction ring at the outside end of the aforementioned pump-motor, i.e., at the end where the pintle shaft is mounted, is carried by a bearing that is affixed to the outside end frame member. Both perpendicular and side loads on that reaction ring are, therefore, transferred to the frame. Meanwhile, the part of the perpendicular load on the pintle shaft not transferred between the pins at the blind end and the slotted bearing is carried by the cantilever mounting, thus requiring the housing or frame to be strongly built to a precision that will ensure proper alignment between the axes of the pintle shaft and reaction assembly. But for the stabilizing mechanisms at the blind end of the pintle shaft, which support the blind end against the cyclical side loads, the cantilever mounting structure would be subject to forces tending to cock the shaft out of line. The cantilever support structure is, however, subject to part of the side loads on the pintle shaft, such part being imposed on the pintle shaft adjusting mechanism.

SUMMARY OF THE INVENTION

The present invention provides an improved construction of the pintle shaft mounting and a better arrangement for the mutual support of the pintle shaft and reaction assembly in a manner which unloads the housing from perpendicular loads from the action and reaction forces on the pintle shaft and reaction assembly and which stabilizes the pintle against the oscillatory side loads. A pump-motor embodying the present invention is generally similar to the pump-motor in U.S. Pat. No. 3,771,423 (the one discussed above) in that it comprises a pintle shaft mounted on guideways on a frame member (which will be called the outside frame member) in cantilevered relation so that it can be translated laterally for adjustment of speed and torque input or output (in the pump or motor mode, as the case may be). The reaction assembly is journaled by way of the input-output shaft on a second or "inside" frame member and includes axially spaced-apart reaction rings which straddle the cylinder block and are driven by (or drive) pistons that are suitably coupled to it, most preferably by Scott-Russell linkages. The principal differences between the invention and the prior pump-motor of the aforementioned patent are:

(1) an improved mounting of the pintle shaft on longer, stronger guideways, the guideways having a length substantially greater than the sum of the outside diameter of the pintle shaft and maximum adjustment distance, thus to provide greater load distribution;

(2) the inside reaction ring is mounted on an inside end bearing which, in turn, is mounted on flat surfaces that are parallel to each other and to the plane of translation of the pintle shaft so that the pintle shaft can be adjusted laterally; and (3) the outside reaction ring is mounted, in much the same way as the inside reaction ring, on an outside end bearing which is likewise borne by flat parallel surfaces on the pintle shaft.

The above-described improvements markedly alter the loadings of the pintle shaft, reaction assembly and frame members to the end that the pintle shaft is highly stable and free of vibration. For one thing, the outside frame member is unloaded from the perpendicular loads of the interaction between the pistons and reaction rings—the perpendicular loads act at the inside and outside reaction ring end bearings, and the axes of the pintle shaft and reaction assembly are assured of remaining parallel, provided that the flats on the pintle shaft which carry the end bearings are true to each other and to the guideways on the pintle shaft. This factor alone simplifies the manufacture (and thus lowers costs) by eliminating several precision machine operations, such as fitting the outside end bearing to the frame and high precision manufacture of the frame. Secondly, the friction forces developed at the flat surfaces between the pintle shaft and the two reaction ring bearings on the pintle shaft counteract part, and preferably all, of the side loads on the pintle shaft and thus highly dampen or entirely eliminate lateral vibration of the pintle shaft and reduce or eliminate the lateral load on the cantilever mounting of the pintle shaft. As mentioned above, the ratios of perpendicular to side loads on the pintle shaft range roughly from 2 to 5—thus the ratios of side to perpendicular loads range from roughly 0.2 to 0.5. It is desirable to design the slide surfaces of the reaction ring bearings on the pintle shaft from the points of view of materials and finishes so that friction forces developed at the slide are about equal to the side loads, i.e., so that the coefficient of friction is approximately equal to the ratio of side to perpendicular loads. Such a construction, according to the invention, "locks" the pintle to the reaction rings by friction forces that offset the side loads tending to cock or rock the pintle shaft. The resulting elimination of vibration reduces wear and noise. The invention eliminates the restraining mechanisms and, of course, the complications and costs of those mechanisms and functions more effectively in stabilizing the pintle than do those mechanisms in any case.

The oscillatory nature of the side loads facilitates the movement of the pintle shaft laterally when it is driven by the adjusting mechanism to alter speed and displacement, in that during each one-half of each cycle of the side load, the direction of the side load is the same as the direction of the adjusting force. In other words, the side load partially cancels the friction force periodically so that the net force resisting adjusting movement of the pintle shaft becomes periodically low.

For a further understanding of the invention, reference may be made to the following description of an exemplary embodiment, taken in conjunction with the accompanying drawings.

DESCRIPTION OF THE DRAWINGS

FIG. 3 is an exploded pictorial view of the fluid supply - return conduit, the pintle shaft, parts of the slide mounting bars, and the bearing blocks; and FIG. 4 is a fragmentary end cross-sectional view taken along the lines 4—4 of FIG. 1 and in the direction of the arrows.

DESCRIPTION OF EXEMPLARY EMBODIMENT

Figure 1:
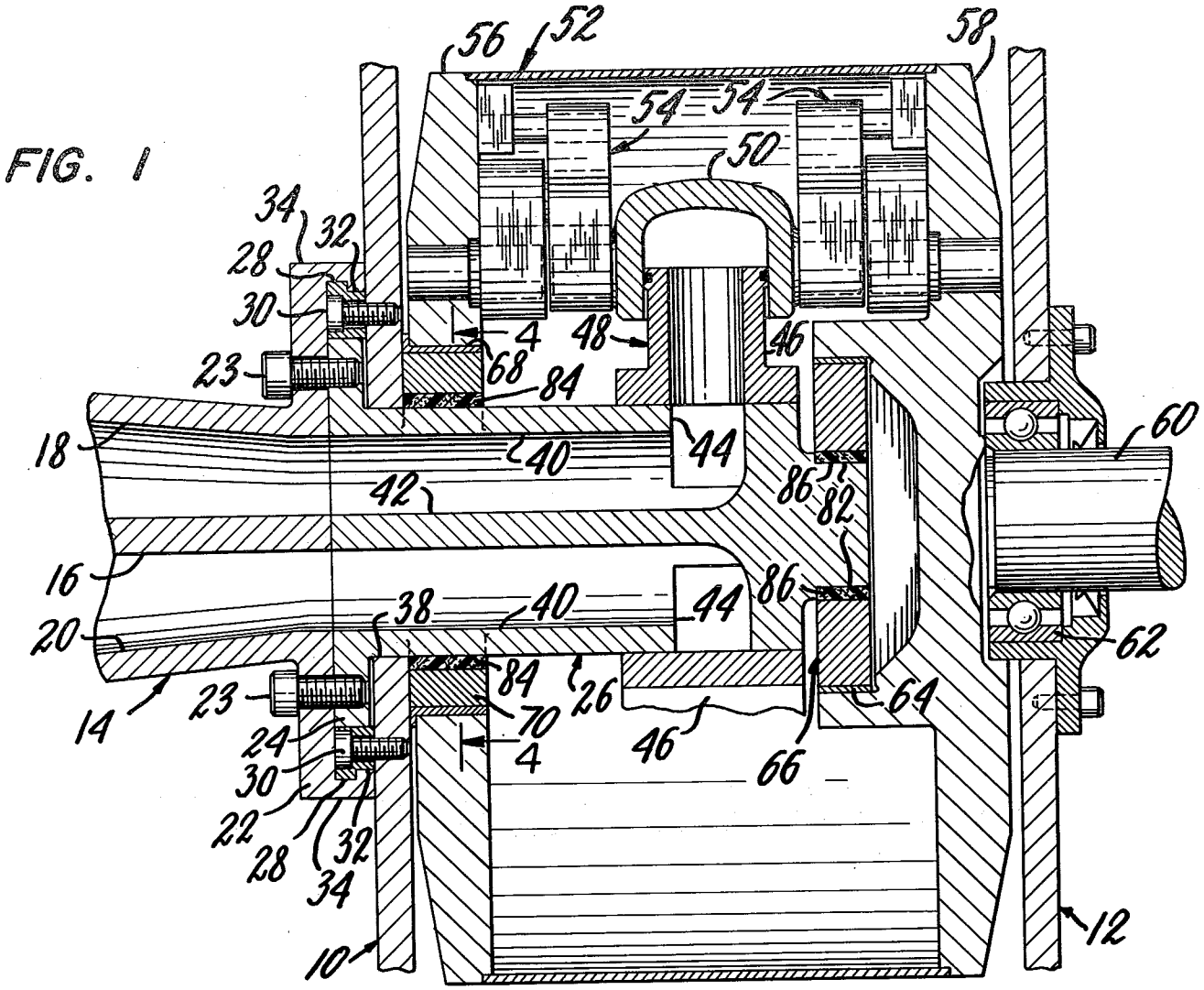
FIG. 1 is a cross-sectional view of the embodiment taken along a diametrical plane represented by the lines 1—1 and in the direction of the arrows in FIG. 2.
Figure 2:
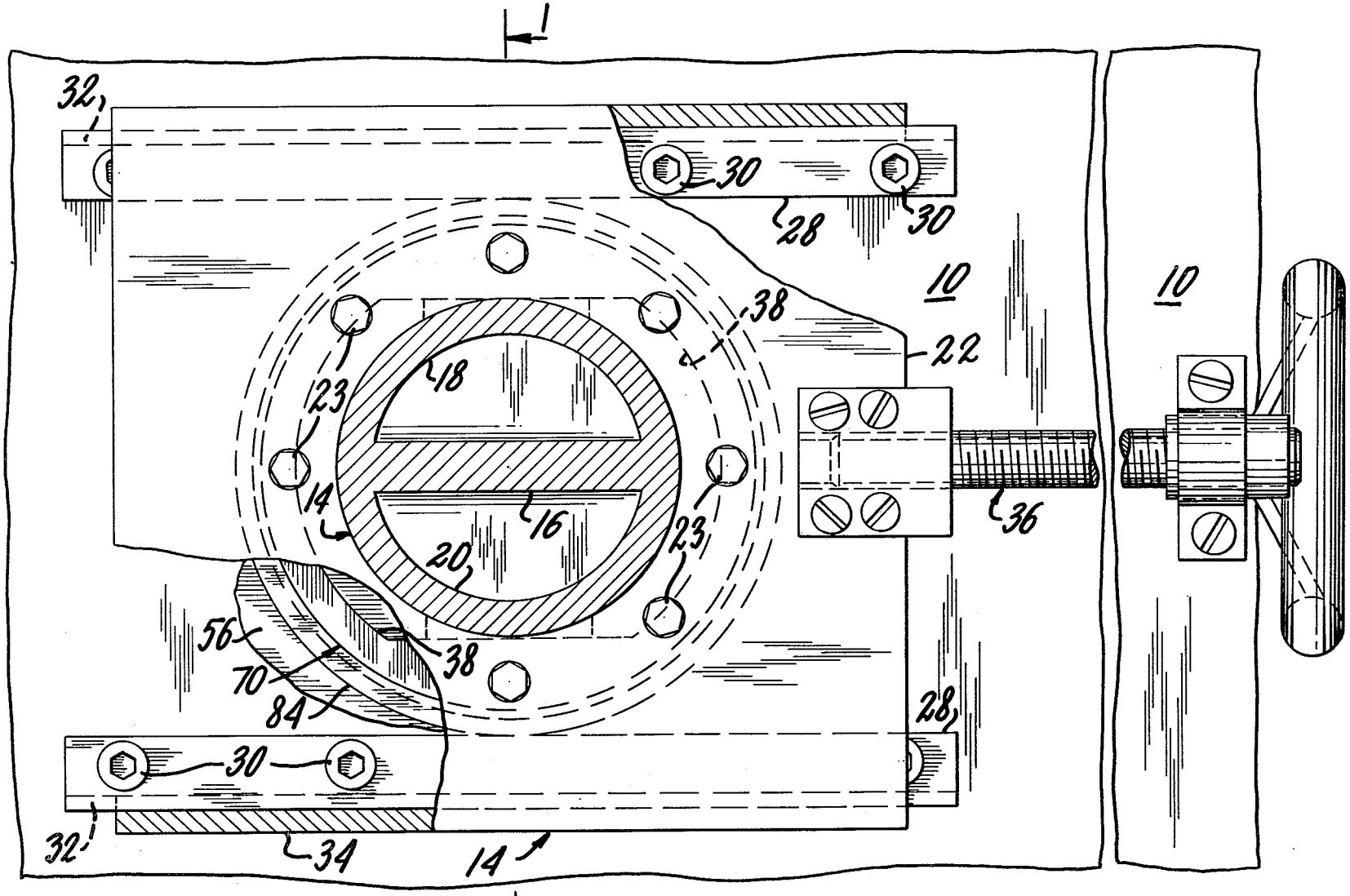
FIG. 2 is an end view of the outside end of the embodiment, portions being broken away for clearer illustration.

The designation of "outside" and "inside" ends is essentially arbitrary and is applied merely for convenience; inside refers to the right and outside to the left in FIG. 1. The outside frame member 10 and inside frame member 12 are plates that are rigidly joined (not shown), preferably as parts of a closed housing for the working parts of the pump-motor. Hydraulic fluid is supplied to and returned from the pump-motor through a supply-return conduit 14 that is divided by a wall 16 into passages 18 and 20. A mounting flange 22 on the inside end of the conduit 14 abuts and is fastened by bolts 23 to a flange 24 on the pintle shaft 26. The conduit 14 and the pintle shaft 26 are mounted on the outside frame member 10 to translate back and forth laterally (along an axial plane perpendicular to the cross-sectional plane of FIG. 1) by parallel guide bars 28 which are fastened by cap screws 30 to the outside frame member and are roughly L-shaped in cross section to define outwardly open guideways 32. The guideways receive L-shaped guide flanges 34 on the mounting flange 22 of the conduit-pintle shaft unit. That unit is shifted to adjust the displacement and the direction of rotation of the pump-motor by any suitable drive device, a hand-driven adjusting screw 36 coupled between the unit and the outside frame member being shown for purposes of illustration.

The pintle shaft 26 extends into the space between the frame members 10 and 12 through an oblong hole 38 in the outside frame member that is wide enough to allow the desired extent of translation. The guideways and the mounting flange have a length substantially greater than the width of the hole (i.e., the sum of the outside diameter of the pintle shaft plus the maximum total translational movement), and the guideways 32 are located a substantial distance from the axis of the pintle shaft. Advantageously, these aspects of the pump-motor provide for favorable load distribution in the cantilevered mounting of the pintle shaft.

The pintle shaft has fluid transfer passages 40 of semicircular cross section which register with the passages 18 and 20 in the conduit 14 and are separated by a transverse bridge 42. The passages 40 open outwardly through ports 44 for delivery and return of fluid to and from radial bores in the cylinders 46 of a cylinder block 48. Each cylinder receives a piston 50 which is coupled to a reaction assembly 52 by Scott-Russel linkages 54. The cylinder block, pistons and linkages of the embodiment are not shown in their entirety because they are known per se; reference may be made to U.S. Pat. No. 3,709,104 for a full description and a complete illustration of these components and the manner in which they operate. The porting of the pump-motor should be designed according to the principles of Tobias U.S. Pat. Nos. 3,345,916, 3,548,719 and Tobias pending U.S. patent application Ser. No. 858,561 to ensure optimum efficiency and to increase maximum speed capability by minimizing energy losses due to restriction and turbulence of the fluid flows to and from the cylinders.

The reaction assembly includes inside and outside reaction rings 56 and 58, respectively. The inside reaction ring 58 is coupled to an input-output shaft 60 which is journaled in a bearing 62 in the inside frame member 12 and is also borne by a sleeve bearing 64 on an inside bearing block 66 carried by the blind end of the pintle shaft. The outside reaction ring rotates on a sleeving bearing 68 on an outside bearing block 70 on the pintle shaft. The bearing blocks have transversely oblong holes 73 and 74 which include parallel flat slide surfaces 76 and 78. The slide surfaces seat on flats 80 and 82 on the pintle shaft; thus, the pintle shaft can translate laterally relative to the bearing blocks, which are non-rotatable on the pintle shaft but support the reaction assembly for rotation about the fixed axis of the input-output shaft 60.

The stability and freedom from vibration of the pump-motor of the present invention provide important improvements in efficiency and quietness. The pintle and reaction assembly are mutually locked together by the forces exchanged between them. In particular, the forces due to hydrostatic pressure on the working side of the pump-motor—the non-working side forces are negligible—can be resolved into a variable, relatively high force component acting perpendicular to the plane of translation and an oscillatory transverse component (i.e., a side-load of variable magnitude and of changing direction at a frequency equal to the number of cylinders times the rate of rotation). The perpendicular load component is distributed and transferred between the bearing blocks and the pintle shaft at the flats. Those load exchanges inherently produce frictional forces acting omnidirectionally in the planes of the flats on the pintle shaft and the companion slide faces on the bearing blocks. Preferably, the coefficient of friction between the slide faces and flats is such that the frictional forces exceed the highest side load. That is best accomplished by providing brake shoes 84 and 86 at the interfaces between the flats and slide faces, the material of the shoes being chosen to provide the desired coefficient of friction.

The perpendicular loads and side loads are mathematically related to each other as functions of machine geometry and bear that relationship regardless of variation in hydrostatic pressure. Similarly, the frictional forces are proportional to the perpendicular loads. Thus, the frictional forces and side loads are related independently of load changes. Accordingly, changes in the frictional forces will track the side loads in the same relation to hydrostatic pressure (i.e., machine load) for stable support of the pintle shaft relative to the reaction assembly throughout the range of load on the pump-motor.

I claim:

1. In a radial piston hydraulic pump or motor which includes spaced-apart inside and outside frame members, an input-output shaft journaled in the inside frame member, a first reaction ring joined to the input-output shaft for rotation therewith about the axis thereof, a pintle shaft mounted on the outside frame member in cantilevered relation and for translation along a plane that includes the axis of the input-output shaft and having a blind end portion located radially inwardly of a portion of the first reaction ring, a cylinder block mounted for rotation on the pintle shaft axially outwardly from the blind end and a second reaction ring mounted axially outwardly from the cylinder block for rotation conjointly with the first reaction ring about the axis of the input-output shaft journal, the improvement wherein the cantilever support for the pintle shaft includes means on the outside frame member defining a pair of guideways extending parallel to each other and to the plane along which the pintle shaft is translatable, one such guideway being on each side of said plane, and spaced a substantial distance from the circumferential surface of the pintle shaft, and each guideway having a length substantially greater than the sum of (a) the transverse dimension of the pintle shaft in said plane and (b) the distance of maximum translation of the pintle shaft axis along said plane, a pair of guide flanges joined to the pintle shaft, each of which is received slidably in one of the guideways of the frame, and wherein the blind end of the pintle shaft is joined to the first reaction ring by a first bearing block which receives the first reaction ring for rotation thereon, the first bearing block having spaced-apart flat surfaces oriented parallel to each other and to the plane of translation of the pintle shaft, and the blind end of the pintle shaft having flat parallel surfaces slidably engaging said flat surfaces on the first bearing block and frictionally engageable due to the resultant force components perpendicular to said plane of translation imposed between said flat surfaces such that the resultant force components parallel to said plane of translation acting on the first bearing block are opposed by frictional forces induced at said surfaces.

2. The improvement according to claim 1, wherein the second reacting ring is mounted for rotation on a second bearing block and wherein the second bearing block is mounted on the pintle shaft intermediate the cylinder block and the outside frame member, the pintle shaft having spaced-apart flat surfaces on diametrically opposite sides which are parallel to the plane of translation of the pintle shaft, and the second bearing block having flat surfaces slidably engaging the flat surfaces of the pintle shaft and frictionally engageable due to resultant force components perpendicular to said plane of translation imposed between said flat surfaces such that the resultant force components parallel to said plane of translation on the second bearing block are opposed by frictional forces induced at said surfaces.

3. The improvement according to claim 2, and further comprising brake shoes at the interfaces between the slide surfaces of the second bearing block and the pintle shaft.

4. The improvement according to claim 1 or 3, and further comprising brake shoes at the interfaces between the slide surfaces of first bearing block and the pintle shaft.

5. The improvement according to claim 4, wherein the brake shoes have a coefficient of friction of not less than the maximum ratio of the resultant force component due to hydrostatic pressure acting on the pintle shaft in a plane parallel to the plane of translation thereof to the resultant force component perpendicular to said plane.

6. In a radial piston hydraulic pump or motor which includes spaced-apart inside and outside frame members, an input-output shaft journaled in the inside frame member, a first reaction ring joined to the input-output shaft for rotation therewith about the axis thereof, a pintle shaft mounted on the outside frame member in cantilevered relation and for translation along a plane that includes the axis of the input-output shaft and having a blind end portion located radially inwardly of a portion of the first reaction ring, a cylinder block mounted for rotation on the pintle shaft axially outwardly from the blind end and a second reaction ring mounted axially outwardly from the cylinder block for rotation conjointly with the first reaction ring about the axis of the input-output shaft journal, the improvement wherein the blind end of the pintle shaft is joined to the first reaction ring by a first bearing block which receives the first reaction ring for rotation thereon, the first bearing block having spaced-apart flat surfaces oriented parallel to each other and to the plane of translation of the pintle shaft, and the blind end of the pintle shaft having flat parallel surfaces slidably engaging said flat surfaces on the first bearing block and frictionally engageable by the resultant force component perpendicular to said plane of translation imposed between said flat surfaces to restrain the blind end of the pintle shaft against movement parallel to said surfaces, and wherein the second reaction ring is mounted for rotation on a second bearing block and wherein the second bearing block is mounted on the pintle shaft intermediate the cylinder block and the outside frame member, the pintle shaft having spaced-apart flat surfaces on diametrically opposite sides which are parallel to the plane of translation of the pintle shaft, and the second bearing block having flat surfaces engaging the flat surfaces on the pintle shaft such that the second bearing block is supported by the pintle shaft and the pintle shaft is translatable relative to the second bearing block along the aforementioned plane of translation.

7. The improvement according to claim 6, and further comprising brake shoes at the interfaces between the slide surfaces of the second bearing block and the pintle shaft.

8. The improvement according to claim 6 or 7, and further comprising brake shoes at the interfaces between the slide surfaces of first bearing block and the pintle shaft.

9. The improvement according to claim 8, wherein the brake shoes have a coefficient of fricion of not less than the maximum ratio of the resultant force component due to hydrostatic pressure acting on the pintle shaft in a plane parallel to the plane of translation thereof to the resultant force component perpendicular to said plane.

* * * * *